US010731302B2

(12) United States Patent
Barresi et al.

(10) Patent No.: US 10,731,302 B2
(45) Date of Patent: Aug. 4, 2020

(54) GUIDE RAIL SUPPORT SUITABLE FOR WITHSTANDING FORCES TRANSVERSE TO A RAILWAY TRACK, AND ASSEMBLY COMPRISING SUCH A GUIDE RAIL SUPPORT

(71) Applicant: VOSSLOH COGIFER, Rueil Malmaison (FR)

(72) Inventors: Francesco Barresi, Strasbourg (FR); Christophe Koebel, Niederschaeffolsheim (FR)

(73) Assignee: VOSSLOH COGIFER, Rueil Malmaison (FR)

( * ) Notice: Subject to any disclaimer, the term of this patent is extended or adjusted under 35 U.S.C. 154(b) by 325 days.

(21) Appl. No.: 15/577,731

(22) PCT Filed: May 27, 2016

(86) PCT No.: PCT/EP2016/062052
§ 371 (c)(1),
(2) Date: Nov. 28, 2017

(87) PCT Pub. No.: WO2016/193165
PCT Pub. Date: Dec. 8, 2016

(65) Prior Publication Data

US 2018/0127923 A1 May 10, 2018

(30) Foreign Application Priority Data

May 29, 2015 (FR) ..... 15 54903

(51) Int. Cl.
*E01B 5/18* (2006.01)
*E01B 5/08* (2006.01)
*E01B 7/20* (2006.01)

(52) U.S. Cl.
CPC ..... *E01B 5/18* (2013.01); *E01B 5/08* (2013.01); *E01B 7/20* (2013.01)

(58) Field of Classification Search
CPC ..... E01B 5/08; E01B 7/20; E01B 5/18
See application file for complete search history.

(56) References Cited

U.S. PATENT DOCUMENTS 1,546,778 A * 7/1925 De Niff ..... E01B 7/20 246/441
1,560,244 A * 11/1925 Kalff ..... E01B 7/20 246/441

(Continued)

FOREIGN PATENT DOCUMENTS

AT 10942 U1 1/2010
EP -0364433 A2 * 4/1990 ..... E01B 7/20

(Continued)

OTHER PUBLICATIONS

Search Report and Written Opinion dated Sep. 21, 2016.

*Primary Examiner* — Zachary L Kuhfuss
(74) *Attorney, Agent, or Firm* — Knobbe, Martens, Olson & Bear, LLP

(57) ABSTRACT

Guide rail support (10) intended to withstand forces (F) exerted in a direction (T) transverse to a railway track on a guide rail (5) extending in a longitudinal direction (L) of the railway track. The guide rail comprises:

a front face (31) in the transverse direction for supporting the guide rail (5) or an attachment part (23) of the guide rail, a lower face (33) in a third direction (V) substantially perpendicular to the longitudinal direction and the transverse direction, wherein the lower face transversely comprises at least one front section (43) and one rear section (45), and at least one reinforcement rib (35) transversely linking the front face and the rear section.

(Continued)

The rear section and the front section respectably define, in a contact plane (P) of the lower face with the rail support, two distinct contact surfaces (47, 49) separated by a section (51) of the contact plane and devoid of any contact with the lower face, while the reinforcement rib spans the said section.

18 Claims, 5 Drawing Sheets

(56) References Cited

U.S. PATENT DOCUMENTS 1,628,882 A * 5/1927 Hoffman ..... E01B 7/20 246/441
3,026,074 A * 3/1962 Kern ..... E01B 7/20 246/441
3,063,641 A * 11/1962 Frey ..... E01B 7/20 238/22
4,005,839 A * 2/1977 Frank ..... E01B 7/00 246/415 R
4,386,751 A * 6/1983 Meyer ..... E01B 7/20 238/22
5,115,970 A * 5/1992 Rice ..... E01B 7/20 238/17
5,148,980 A * 9/1992 Fritz ..... E01B 7/20 238/17
5,169,064 A * 12/1992 Rice ..... E01B 7/20 238/17
2018/0127923 A1* 5/2018 Barresi ..... E01B 5/18

FOREIGN PATENT DOCUMENTS

EP 0364433 A2 4/1990
EP 1253243 A2 10/2002
GB 2424439 A 9/2006

* cited by examiner

GUIDE RAIL SUPPORT SUITABLE FOR WITHSTANDING FORCES TRANSVERSE TO A RAILWAY TRACK, AND ASSEMBLY COMPRISING SUCH A GUIDE RAIL SUPPORT

CROSS-REFERENCE TO RELATED APPLICATIONS

This application is the U.S. National Phase under 35. U.S.C. § 371 of International Application PCT/EP2016/062052, filed May 27, 2016, which claims priority to French Patent Application No. 1554903, filed May 29, 2015. The disclosures of the above-described applications are hereby incorporated by reference in their entirety.

FIELD OF THE INVENTION

The present invention relates to a guide rail support intended to withstand forces exerted in a direction transverse to a railway track on a guide rail extending in a longitudinal direction of the railway track, wherein the guide rail support comprises:

- a front face in the transverse direction intended to carry the guide rail or an attachment part of the guide rail,
- a lower face in a third direction, wherein the third direction is substantially perpendicular to the longitudinal direction and the transverse direction, and wherein the lower face comprises transversely at least a front section and a rear section, and wherein the lower face is intended to define a contact plane with a track support, and
- at least one reinforcement rib transversely connecting the front face and the rear section of the lower face.

BACKGROUND OF THE INVENTION

Guide rails are safety features of well-known track apparatus. The guide rails are arranged substantially parallel to a rail of a railway track, on the inner side of the track, to prevent the wheel of a railway vehicle traveling on the railways from being detached transversely from the rail in question. This transverse displacement of the railway vehicle could damage a track apparatus or even cause a derailment.

The role of the guide rail is, therefore, to oppose this transverse displacement of the railway vehicle. The guide rail is fixed on a guide rail support, that is itself fixed by its lower face on a track support. The guide rail support must therefore withstand very large transverse forces.

Current guide rail supports are designed to withstand a transverse force in the order of 50 kN. However, the evolution of the railway markets towards heavier loads will increase the mechanical stresses to which the guide rail support is subjected in a repetitive manner.

Tests carried out on prior art guide rail supports show that they are not designed to accept such an evolution of the railway markets.

An object of the invention is, therefore, to provide a guide rail support which is mechanically adapted to the evolution of the railway markets, i.e. in particular, that may absorb repetitive transverse forces related to the passage of a railway vehicle, wherein these forces may go up to 100 kN.

SUMMARY OF THE INVENTION

To this end, the invention relates to a guide rail support of the type described above, wherein the rear section and the front section respectively define, in the contact plane, two distinct contact surfaces separated by a section of the contact plane without there being any contact with the lower face, while the reinforcement rib spans the section.

According to particular embodiments, the guide rail support comprises one or more of the following characteristics, taken individually or in any technically feasible combination:

- the guide rail support further comprises at least one second reinforcement rib transversely connecting the front face and the rear section of the lower face, wherein the reinforcement rib, the second reinforcement rib, the rear section and the front section define an opening in the lower face in the third direction;
- the lower face comprises an arcuate wall transversely connecting the rear section and the front section, wherein the arcuate wall spans the section of the contact plane, and the arcuate wall preferably forms a lower edge of the reinforcement rib in the third direction;
- the rear section of the lower face comprises a first section, and a second section protruding transversely from the first section towards the front section, wherein the second section comprises at least one additional attachment or an abutment intended to interact with the track, and wherein the second section defines an additional contact surface in the contact plane;
- the front face comprises an upper wall intended to receive the guide rail or an attachment part of the guide rail and a lower wall located under the upper wall in the third direction, wherein the lower wall connects the upper wall to the front section of the lower face, while the lower wall is devoid of any opening;
- the rear section of the lower face defines one of an abutment or a housing to interact with the other of an abutment or a housing of the track support in order to oppose a transverse displacement of the guide rail support rearwards with respect to the track support;
- the rear section comprises at least one section non-integral with the reinforcement rib, wherein the non-integral section forms an abutment to oppose a transverse displacement of the reinforcement rib rearwards relative to the track support;
- the rear sections of the reinforcement ribs are situated in the transverse extension of the front sections of the reinforcement ribs and converge substantially towards each other in the transverse direction in a sense going from the front section towards the rear section, and
- the attachment part has a longitudinal extension substantially equal to the longitudinal spacing between the reinforcement ribs, wherein the reinforcement ribs are in the transverse extension of longitudinal ends of the attachment part.

The object of the invention is also an assembly comprising:

- a guide rail support as defined above,
- a guide rail intended to absorb the forces exerted transversely, wherein the forces are intended to be applied at an application point, wherein the application point is furthest from the rear section of the guide rail support in the transverse direction, while the application point is at a height from the contact plane in the third direction, and
- at least one first attachment attaches the guide rail on the front face or on an attachment part, at least one second attachment intended to attach the front section on the track support, and at least one third attachment intended to attach the rear section on the track support, wherein the second attachment and the third attachment are transversely separated by a center distance, wherein the ratio of the center distance divided by the height lies between 0.25 and 10, preferably between 0.75 and 5, even more preferably between 1.0 and 3.

According to particular embodiments, the assembly comprises one or more of the following characteristics, taken in isolation or in any technically feasible combination:

- the insulating base plate has a thickness of between 1 and 5 mm, preferably between 1.5 and 2.5 mm,
- the insulating base plate is made of polymer, and
- the insulating base plate has a hardness of between 50 and 100 Shore A;
- a switching point, and
- a spacer extending in the transverse direction between the switching point and the guide rail support; and
- a point where a bending moment is exerted due to the transverse forces is located substantially at the axis of a third attachment along the transverse direction.

BRIEF DESCRIPTION OF THE DRAWINGS

The invention will be better understood upon reading the description which follows, given only by way of example and with reference to the appended drawings, wherein.

DETAILED DESCRIPTION OF THE PREFERRED EMBODIMENTS

Figure 1:
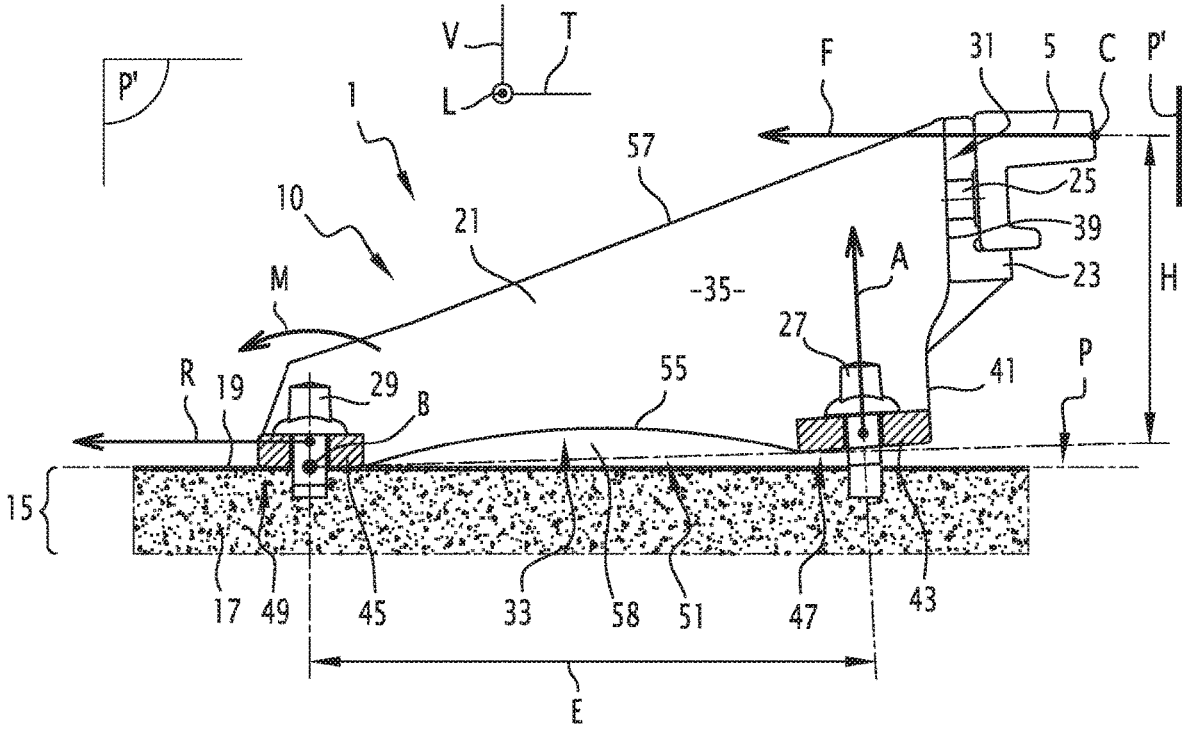
FIG. 1 shows a sectional view also in a plane perpendicular to the longitudinal direction of an assembly according to a first embodiment of the invention.

An assembly 1 according to a first embodiment of the invention is described with reference to FIG. 1. The assembly 1 is, for example, intended to be part of a track apparatus (not shown) of a railway (not shown).

The assembly 1 comprises a guide rail 5 extending in a longitudinal direction L of the railway track, a guide rail support 10, and a track support 15 on which the rail support is attached.

The guide rail 5 is intended to absorb forces F exerted in a transverse direction T of the railway by a railway vehicle (not shown) circulating on the railway. The guide rail 5 is attached on the guide rail support 10.

The transverse direction T is substantially perpendicular to the longitudinal direction L and substantially parallel to the ground. In addition, a third direction V substantially perpendicular to the longitudinal direction L and to the transverse direction T is defined. The third direction V is vertical in the example shown, and the floor is substantially horizontal.

The forces F are applied at the application point C. The point C is, for example, determined by bringing a plane P' closer to the guide rail 5, while the plane P' is perpendicular to the transverse direction T.

The track support 15 comprises a foundation 17, made, for example, of concrete, and an insulating base plate 19 located between the guide rail support 10 and the foundation in the third direction V.

The insulating base plate 19 makes it possible to prevent the crumbling of the foundation 17 as a result of micro-movements or repeated shocks on the guide rail support 10.

The insulating base plate 19 is made of a polymer material, for example polyamide. The insulating base plate 19 has high hardness, advantageously between 50 and 100 Shore A.

The insulating base plate 19 advantageously has a thickness in the third direction V of between 1 and 5 mm, for example about 2 mm.

The guide rail support 10 comprises a body 21, and optionally an attachment 23 interposed between the guide rail 5 and the body 21 in the transverse direction T. The guide rail support 10 further comprises a plurality of attachments, including at least a first attachment 25, a second attachment 27 and a third attachment 29, the roles of which will become apparent below.

The guide rail support 10 is advantageously made entirely of metal, metal alloy, or a composite material.

Figure 3:
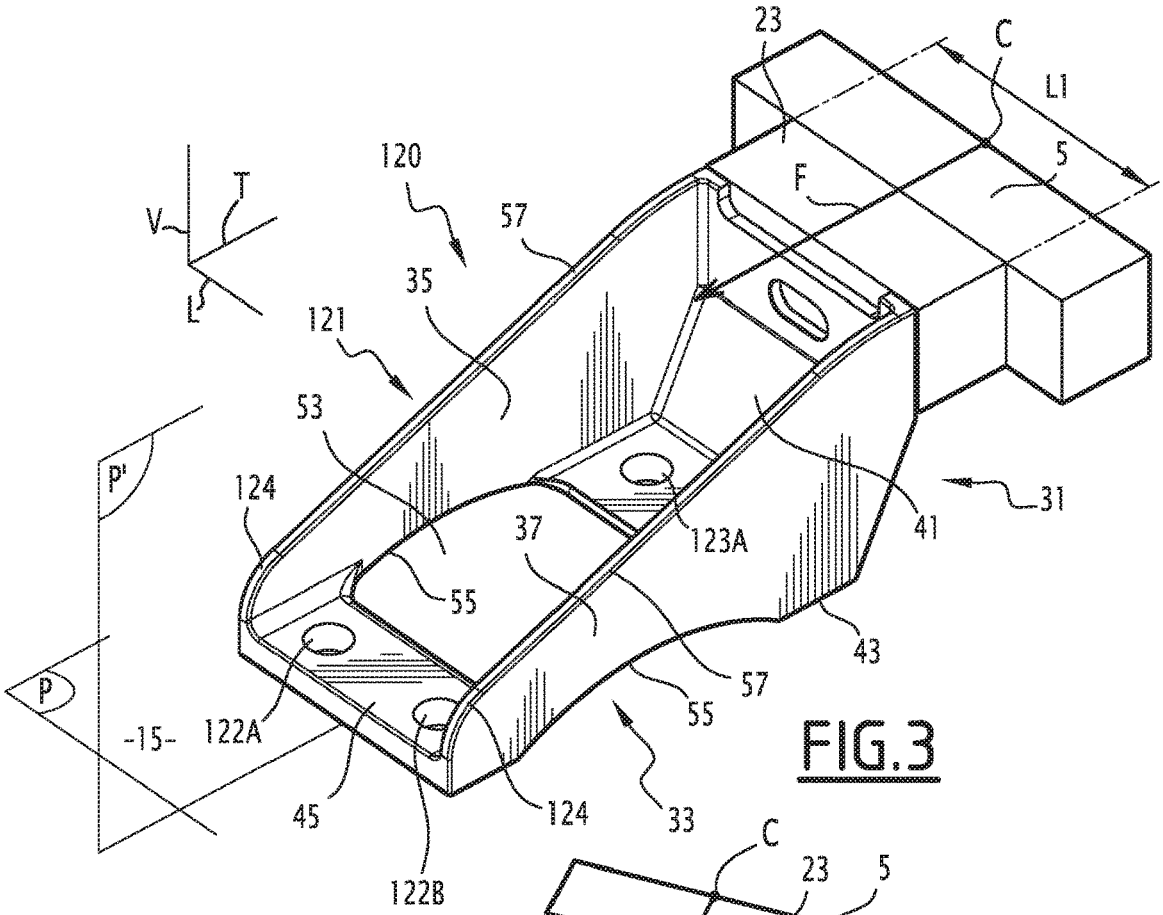
FIG. 3 shows a perspective view of a guide rail support according to the invention, wherein the guide rail support is similar to the guide rail support shown in FIG. 1.

The body 21 of the guide rail support 10 comprises a front face 31 in the transverse direction T, a lower face 33 in the third direction V, and two reinforcement ribs 35, 37 (more visible in the variant shown in FIG. 3).

In the example shown in FIG. 1, the front face 31 is substantially perpendicular to the transverse direction T. The front face 31 is in contact with the intermediate part 23. The front face 31 is adapted to absorb the forces F transmitted by the guide rail 5 and the attachment part 23.

The front face 31 comprises an upper wall 39 located opposite the guide rail 5 in the transverse direction T, and a lower wall 41 located under the upper wall 39 in the third direction V and connecting the upper wall to the lower face 33.

The lower wall 41 is advantageously devoid of any opening, in order to reinforce the strength of the front face 31.

According to certain variants, like that shown in FIG. 3, the lower wall 41 forms a non-zero angle with the third direction V.

The lower face 33 defines a contact plane P with the track support 15, at least when the guide rail support 10 is not subjected to the forces F. The lower face 33 comprises transversely at least a front section 43 and a rear section 45, both in contact with the track support 15 in the contact plane P.

The front section 43 is fixed on the track support 15 by means of the second attachment 27.

The rear section 45 is attached on the track support 15 by the third attachment 29.

The second attachment 27 and the third attachment 29 are, for example, lag bolts screwed into the foundation 17.

The front section 43 and the rear section 45 respectively define, in the contact plane P, two contact surfaces 47, 49 that are distinct and separated by a section 51 of the contact plane P and devoid of any contact with the lower face 33.

The lower face 33 is not in full contact with the contact plane P. The lower face 33 is in particular not flat.

By "distinct" is meant here, for example, that the contact surfaces 47, 49 are not interconnected by a continuous contact zone in the contact plane P, or, for example, that each of the contact surfaces 47, 49 has an outer contour forming a switchback in the contact plane P, wherein the switchbacks are separated from each other.

In the example shown, the reinforcement ribs 35, 37 are substantially perpendicular to the longitudinal direction L, and are, therefore, in particular substantially parallel to each other. The reinforcement ribs 35, 37 are advantageously located transversely on either side of the lower face 33. Thus, the reinforcement ribs 35, 37, the front section 43 of the lower face 33, and the rear section 45 define an opening 53 in the lower face 33 in the third direction V.

The opening 53 is, for example, substantially rectangular when viewed along the third direction V (FIG. 3).

The reinforcement ribs 35, 37 form a bridge connecting the front section 43 and the rear section 45 of the lower face 33. In other words, the reinforcement ribs 35, 37 span the section 51 of the contact plane P and is devoid of any contact with the lower face 33.

In the example shown in FIG. 1, as well as in the variant shown in FIG. 3, each of the reinforcement ribs 35, 37 has an arcuate lower edge 55 transversely connecting the front section 43 and the rear section 45.

Each of the reinforcement ribs 35, 37 also comprises an upper edge 57 transversely connecting the front face 31 and the rear section 45.

Figure 4:
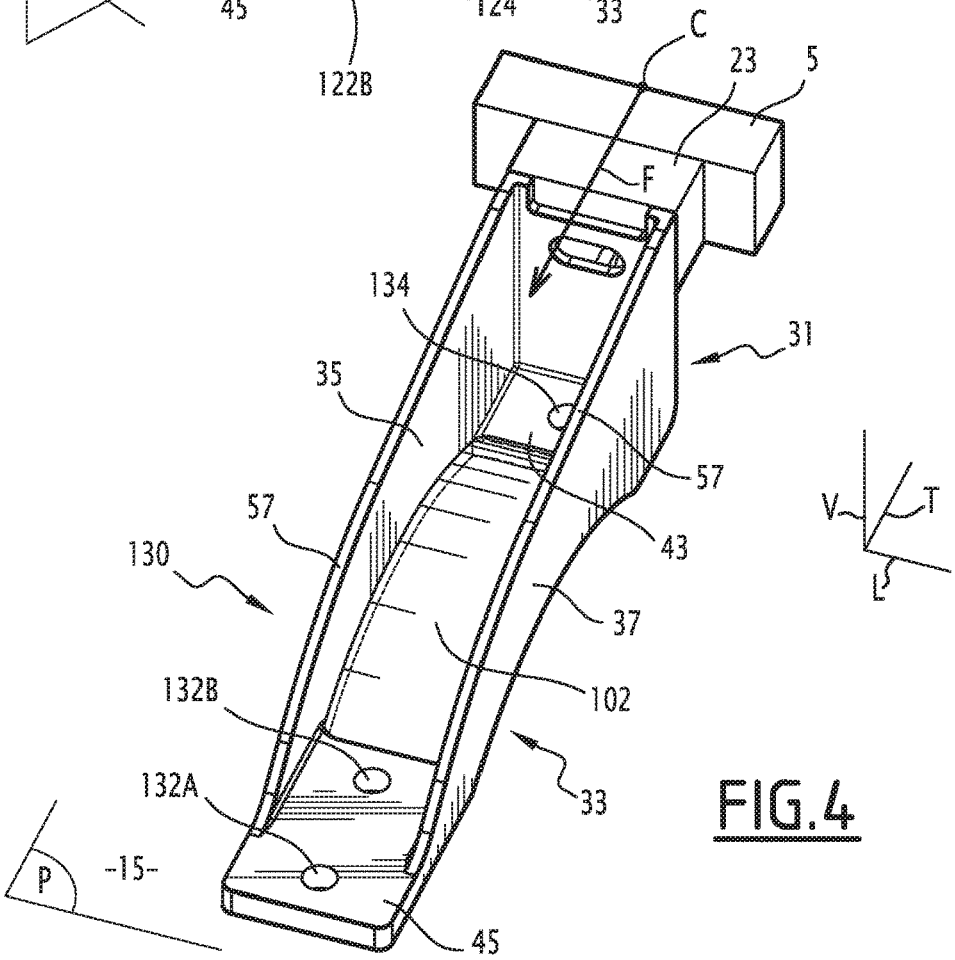
FIG. 4 shows a perspective view of a guide rail support according to the invention, wherein the guide rail support constitutes a variant of the guide rail support shown in FIG. 2.

The upper edge 57 is, for example, rectilinear as in the example shown in FIG. 1, or arched with an upwards convexity, as in the variant shown in FIG. 4.

When viewed in the longitudinal direction L, the guide rail support 10 and the track support 15 define an opening 58 located transversely between the front section 43 and the rear section 45 of the lower face 33, underneath the reinforcement ribs 35, 37.

According to a variant not shown, the body 21 of the guide rail support 10 has only one reinforcement rib advantageously extending along a median plane P' (FIG. 1) of the guide rail support 10.

The application point C is, for example, the point of the guide rail 5 furthest transversely from the rear section 45. The application point C of the forces F defines a height H in the third direction (V).

The second attachment 27 and the third attachment 29 are separated transversely by a center distance E.

Advantageously, the ratio of the center distance E divided by the height H is between 0.25 and 10, preferably between 0.75 and 5, even more preferably between 1.0 and 3.

The operation of the assembly 1 is deduced from its structure and will now be briefly described.

When the guide rail support 10 is not subjected to the forces F exerted by the railway vehicle, the contact surface 47 of the front section 43 of the lower face 33 is in the contact plane P. The contact plane P is, for example, formed by an upper surface of the insulating base plate 19.

When the railway vehicle exerts transverse forces F, they communicate with the guide rail support 10 which acts as a shim. The forces F result in shearing forces A exerted on the second attachment 27 and oriented substantially in the third direction V, and by thrust forces R exerted on the third attachment 29.

The forces F also result in a bending moment M which is exerted in the vicinity of a point B around the longitudinal direction L. The point B is located substantially at the axis of the third attachment 29 in the transverse direction T. By virtue of its particular shape, the guide rail support 10 is designed to withstand the fatigue imposed by the repetitive occurrence of the bending moment M.

Unlike the guide rail supports of the prior art whose lower face consists of a continuous and rectilinear base plate between the front section 43 and the rear section 45, no appreciable flexural displacement occurs in the region of point B. In the guide rail supports of the prior art, the applied forces cause breaks in the guide rail support (lower base plate, reinforcement ribs) and/or fracture or shearing of the lag bolts.

As a result of the features described above, the guide rail support 10 is more resistant to fatigue.

Moreover, as a result of the particular ratio between the center distance E and the height H, the shearing forces A are minimized. This ratio also makes it possible to reduce the stresses in the guide rail support 10.

The shearing deformation of the insulating base plate 19 is advantageously less than 0.05 mm under the effect of the forces F.

In addition, the lack of any opening in the lower wall 41 of the front face 31 prevents the appearance of stress concentration in the front face.

The guide rail support 10 generally withstands the forces F better than the guide rail supports of the prior art. The guide rail support 10 is particularly suitable for withstanding forces of up to 100 kN or more.

In general, the shape of the guide rail support 10 minimizes the stresses that appear due to the application of the forces F.

Figure 2:
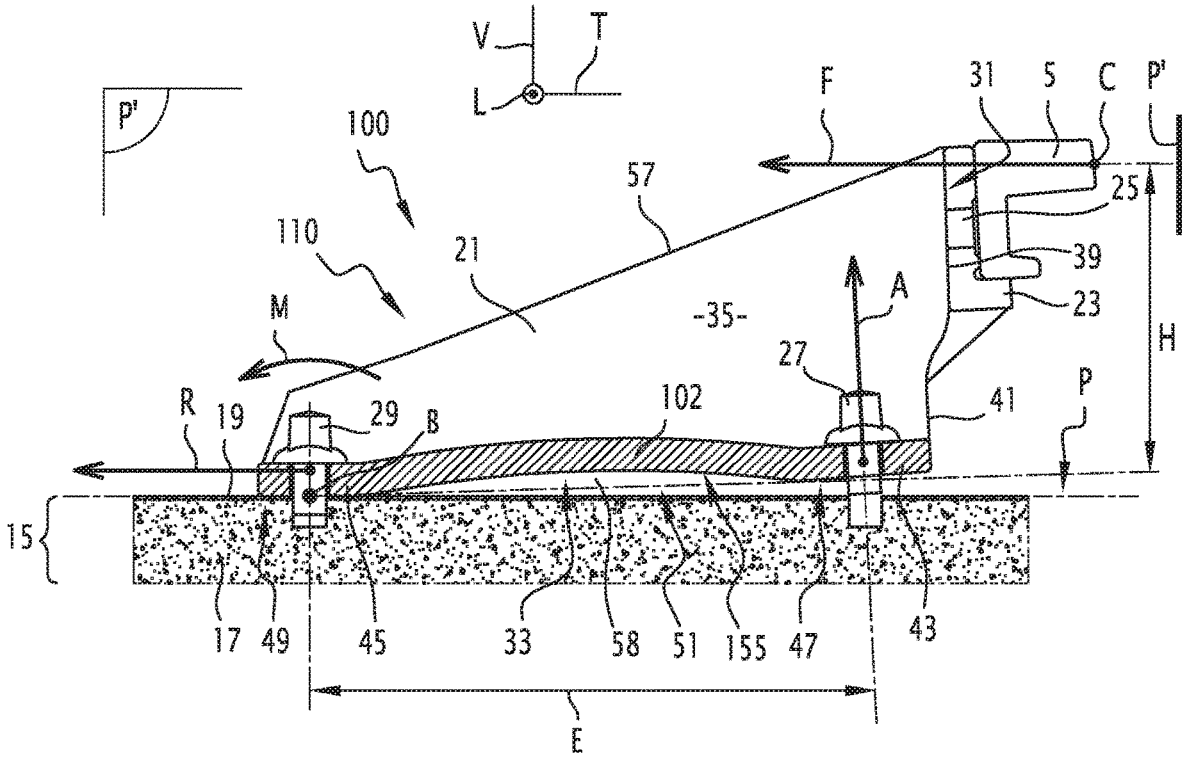
FIG. 2 shows a cross-sectional view of an assembly according to a second embodiment of the invention.

With reference to FIG. 2, an assembly 100 is described according to a second embodiment of the invention. The assembly 100 is similar to the assembly 1 shown in FIG. 1. The similar elements bear the same reference numerals and will not be described again. Only the differences will be described in detail below.

The assembly 100 comprises a body 121 which differs slightly from the body 21. The body 121 comprises an arcuate wall 102 connecting the front section 43 and the rear section 45. There is therefore no opening here that is equivalent to the opening 53 of the guide rail support 10. The arcuate section 102 forms a lower base plate in the third direction V. The arcuate section 102 spans the section 51 of the contact plane P and is devoid of any contact with the lower face 33.

The arcuate wall 102 has a lower surface 155 that is itself arcuate, with a convexity facing upwards.

The lower surface 155 transversely connects the contact surfaces 47, 49.

The arcuate wall 102 further forms a lower edge of the reinforcement ribs 35, 37.

The operation of the assembly 100 is similar to that of the assembly 1. In particular, thanks to the arcuate wall 102, no appreciable flexural displacement occurs around the longitudinal direction L in the vicinity of the point B. Stress related to the application of the forces F are minimized. Thus, the guide rail support 110 and the attachments are more resistant to fatigue caused by the repetitive forces F than the prior art guide rail supports and their attachments.

With reference to FIG. 3, a guide rail support 120 is described according to a first variant of the guide rail support 10 shown in FIG. 1.

The guide rail support 120 is similar to the guide rail support 10. Only the differences will be described in detail below.

In the guide rail support 120, the lower wall 41 of the front face 31 is inclined. This advantageously reduces the stresses in the front face 31.

The front section 43 and the rear section 45 of the lower face 33 each comprise two openings 122 designed to receive two attachments (not shown) of the body 121 on the track support 15. This reinforces the transverse anchorage of the guide rail support 120.

The upper edge 57 of the reinforcement ribs 35, 37 has a rounding 124 above the rear section 45 of the lower face 33.

The attachment part 23 has a longitudinal extension L1 substantially corresponding to the longitudinal spacing between the reinforcement ribs 35, 37. The reinforcement ribs 35, 37 are therefore in the transverse extension of the longitudinal ends of the attachment part 23.

FIG. 4 describes a guide rail support 130 constituting a first variant of the guide rail support 110 shown in FIG. 2.

The guide rail support 130 is similar to the guide rail support 110. In particular, the guide rail support 130 comprises the arcuate lower wall 102 connecting the front section 43 and the rear section 45 of the lower face 33.

The rear section 45 comprises two openings 132A, 132B advantageously aligned transversely and allowing, for example, the respective reception of a lag bolt on the track support 15. This reinforces the transverse anchoring of the guide rail support 130.

The front section 43 comprises, for example, a single opening 134 adapted to advantageously receive a retaining bolt.

Figure 5:
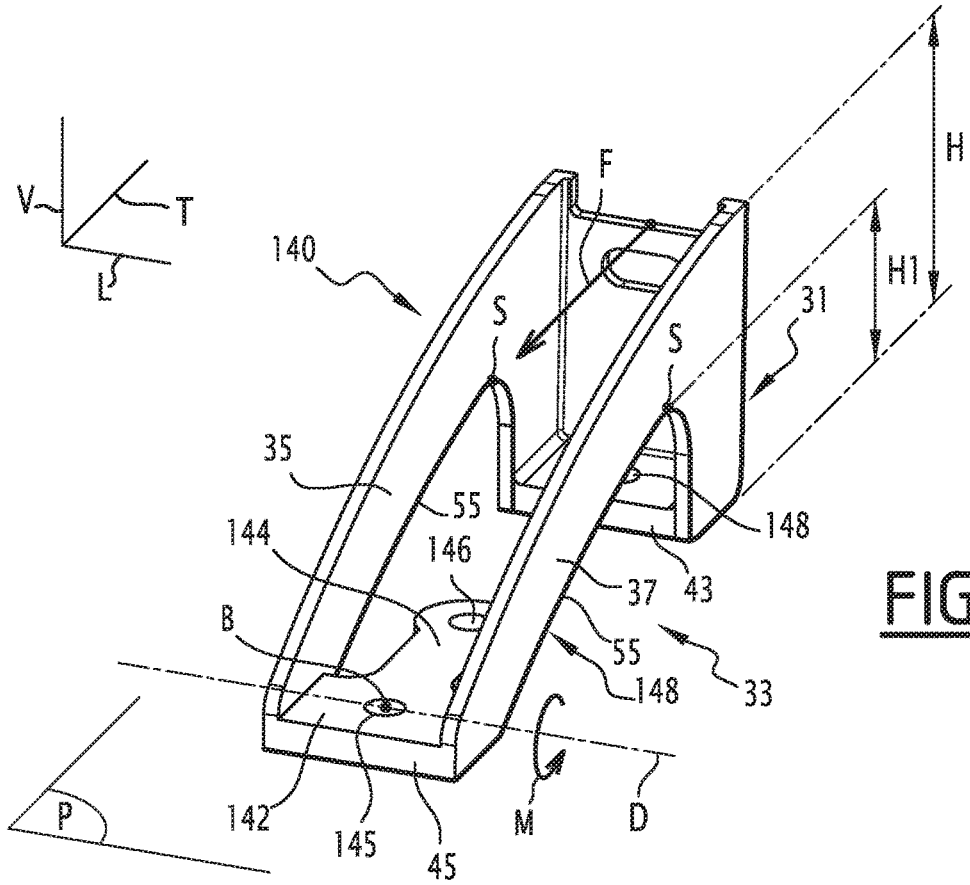
FIG. 5 shows a perspective view of a guide rail support according to the invention, and constitutes a second variant of the guide rail support shown in FIG. 1.

With reference to FIG. 5, a guide rail support 140 is described according to a second variant of the guide rail support 10 shown in FIG. 1. Only the differences will be described in detail below.

In this variant, the lower edge 55 of the reinforcement ribs 35, 37 is more arched. Each lower edge 55 has, for example, an apex S making it possible, when the lateral force is applied, to obtain a constant level of mechanical stresses in the guide rail support while minimizing the maximum value of these stresses and minimizing the weight of the part.

The rear section 45 of the lower face 33 comprises a first section 142 and a second section 144 projecting transversely from the first section towards the front section 43.

The first section 142 comprises at least one opening 145 designed, for example, to receive the third attachment (not shown).

The second section comprises an opening 146 designed to receive at least one additional attachment, for example a lag bolt (not shown), while defining an additional contact surface 148 in the contact plane P.

The guide rail support 140 operates in a similar manner to the guide rail support 10. However, the second section 144 functions as a hinge about an axis D oriented substantially longitudinally and passing through the point B. In fact, when the guide rail support 140 is subjected to the forces F related to the passage of the railway vehicle, there may be a slight bending around the axis D.

The point B is located substantially on the axis of the opening 145, corresponding to the rearmost attachment of the rearmost section 45 in the transverse direction T.

The lower edge 55 of the reinforcement ribs 35, 37 links the rear section 45 at the level of the first section 142.

Figure 6:
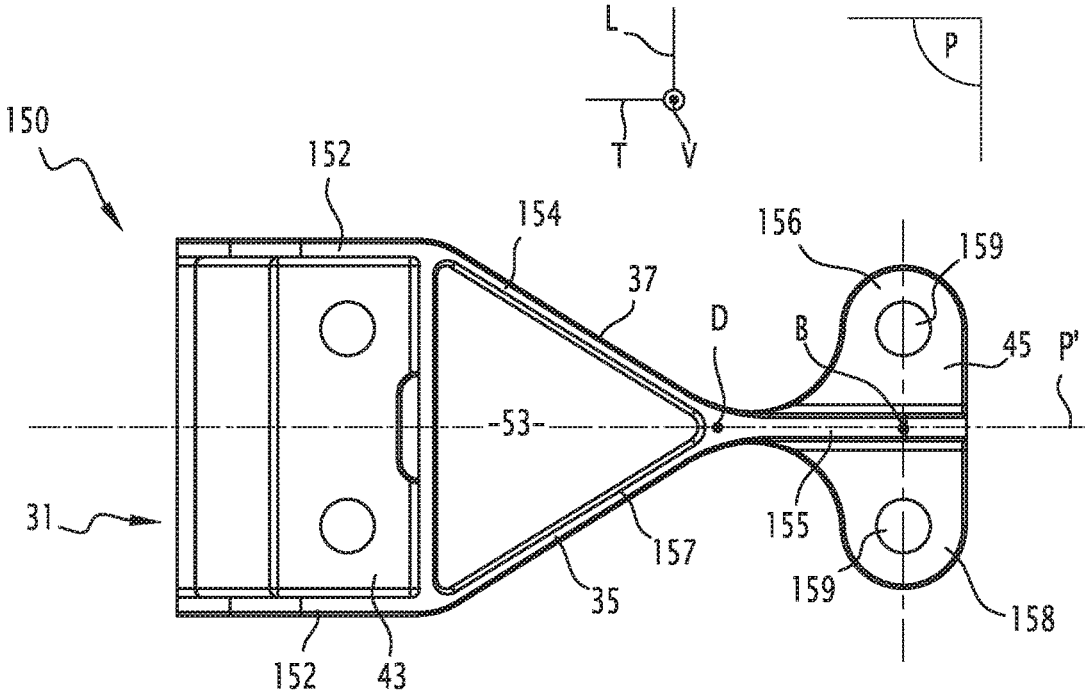
FIG. 6 shows a view from above of a guide rail support according to the invention constituting a third variant of the guide rail support represented in FIG. 1, FIGS. 7 to 9 show cross-sectional views of three guide rail supports according to the invention, wherein the guide rail supports comprise abutments intended to interact with the track support and respectively constitute a fourth, a fifth and a sixth variant of the guide rail support shown in FIG. 1.

With reference to FIG. 6, a guide rail support 150 is described forming a third variant of the guide rail support 10 shown in FIG. 1. Only the differences are described in detail below.

In a plan view in the third direction V, the reinforcement ribs 35, 37 are not completely parallel to each other. The reinforcement ribs 35, 37 respectively comprise a front section 152 in the transverse direction T, and a rear section 154. The reinforcement ribs 35, 37 are advantageously symmetrical relative to the median plane P'.

The front sections 152 of the reinforcement ribs 35, 37 are located transversely at the level of the front section 43 of the lower face 33 and are advantageously substantially parallel to each other.

The rear sections 154 of the reinforcement ribs 35, 37 are located in the transverse extension of the front sections 152 of the reinforcement ribs 35, 37 and converge substantially towards one another at a point D situated transversely between the front section 43 and the rear section 45 of the lower face 33.

The front sections 152 and the rear sections 154 of the reinforcement ribs 35, 37 are, for example, substantially perpendicular to the contact plane P.

The rear section 45 has, for example, two lobes 156, 158 extending on either side of the median plane P' in the longitudinal direction L. The lobes 156, 158 are advantageously symmetrical relative to one another according to the mediator plan P'.

Each lobe 156 advantageously comprises an opening 159 that is designed, for example, to receive a lag bolt (not shown).

Figure 7:
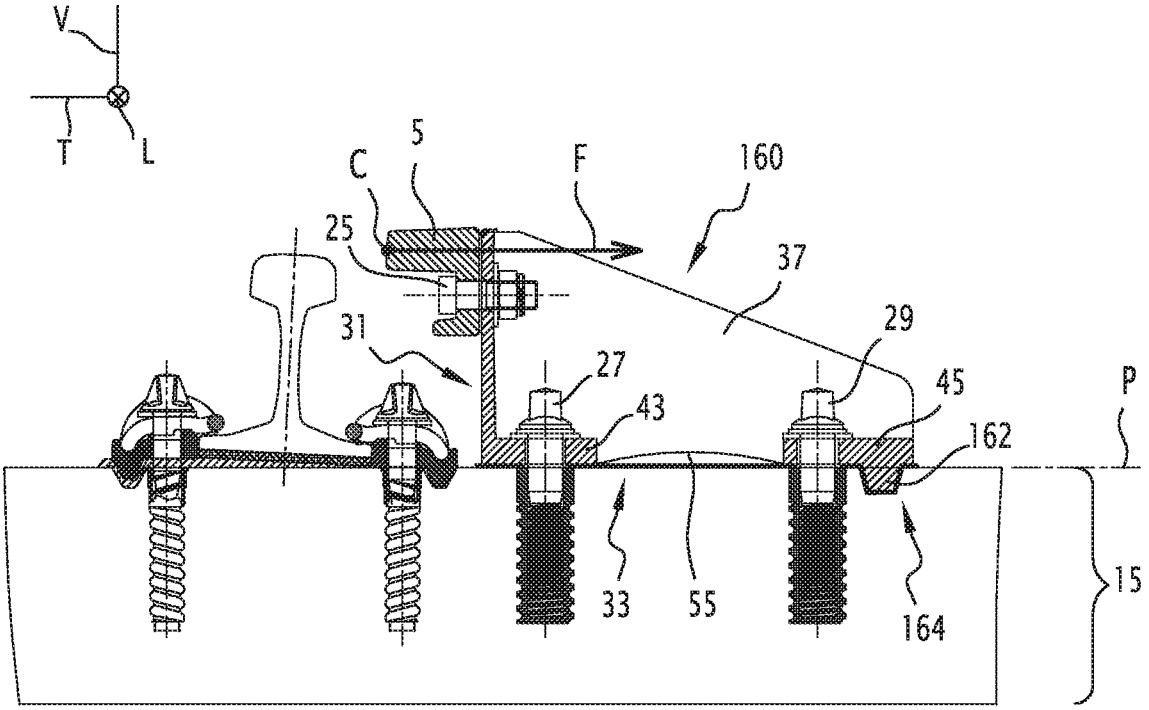
Figure 9:
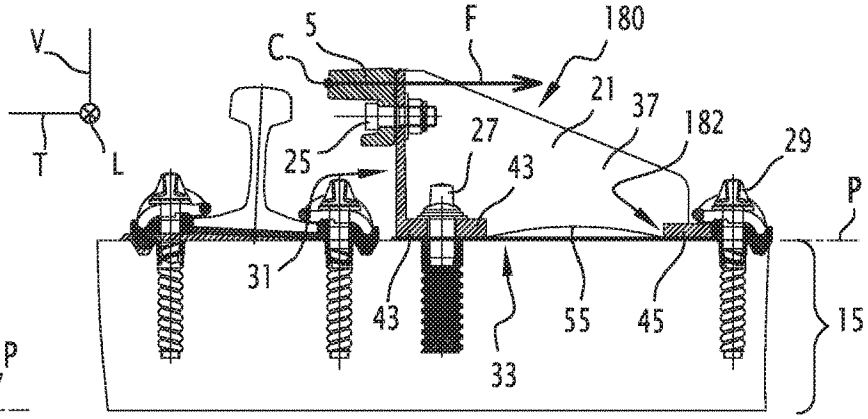
Figure 8:
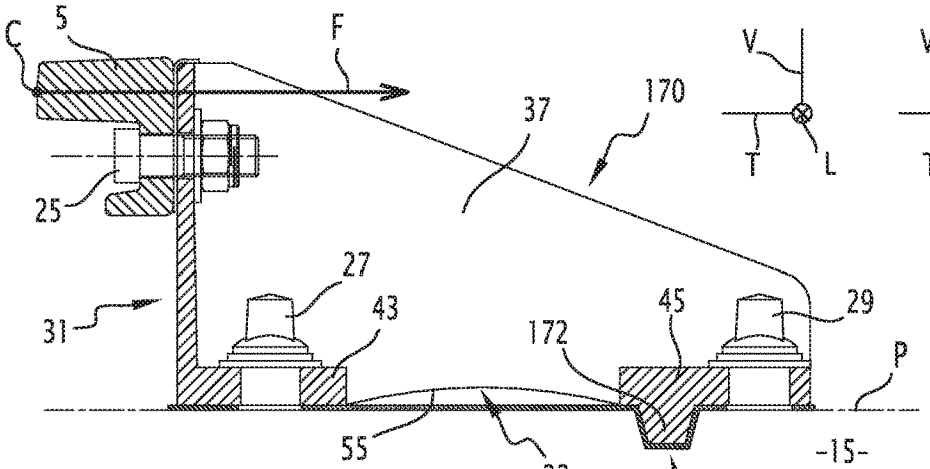

With reference to FIGS. 7 to 9, the guide rail supports 160, 170, 180 are described respectively as forming a fourth, a fifth and a sixth variant of the guide rail support 10 shown in FIG. 1. Only the differences will be described in detail below.

In the guide rail support 160 (FIG. 7), the rear section 45 advantageously defines an abutment 162 that is received in a housing 164 of the track support 15.

The abutment 162 is located transversely on the side opposite to the second attachment 27 with respect to the third attachment 29 (i.e. at the rear of the guide rail support 160). The abutment 162 protrudes downwards from the contact plane P in the third direction V.

According to a variant not shown, the track support 15 forms an abutment that is received in a housing defined by the rear section 45.

The abutment 162 and the housing 164 interact to reduce the recoil of the guide rail support 160 relative to the track support 15 possibly occurring in the transverse direction T when the forces F are applied by the rail vehicle.

In the guide rail support 170 shown in FIG. 8, the rear section 45 defines an abutment 172 that is received in a housing 174 of the track support 15.

The abutment 172 and the housing 174 differ from the abutment 162 and the housing 164 of the guide rail support 160 in that they are located transversely on the other side of the third attachment 29, i.e. they lie between the first section 43 and the second section 45.

The abutment 172 also serves to limit the possible transverse displacement of the guide rail support 170 when the forces F are applied.

In the guide rail support 180 shown in FIG. 9, the rear section 45 is not integral with the rest of the body 21, in particular with the reinforcement ribs 35, 37.

The rear section 45 defines an abutment 182 designed to oppose a transverse displacement of the reinforcement ribs 35, 37 rearwards with respect to the contact plane P.

The rear section 45 is also fixed on the track support 15 by the third attachment 29 which, in the example shown, is an elastic attachment. This allows an adjustment of the position of the abutment 182.

Figure 10:
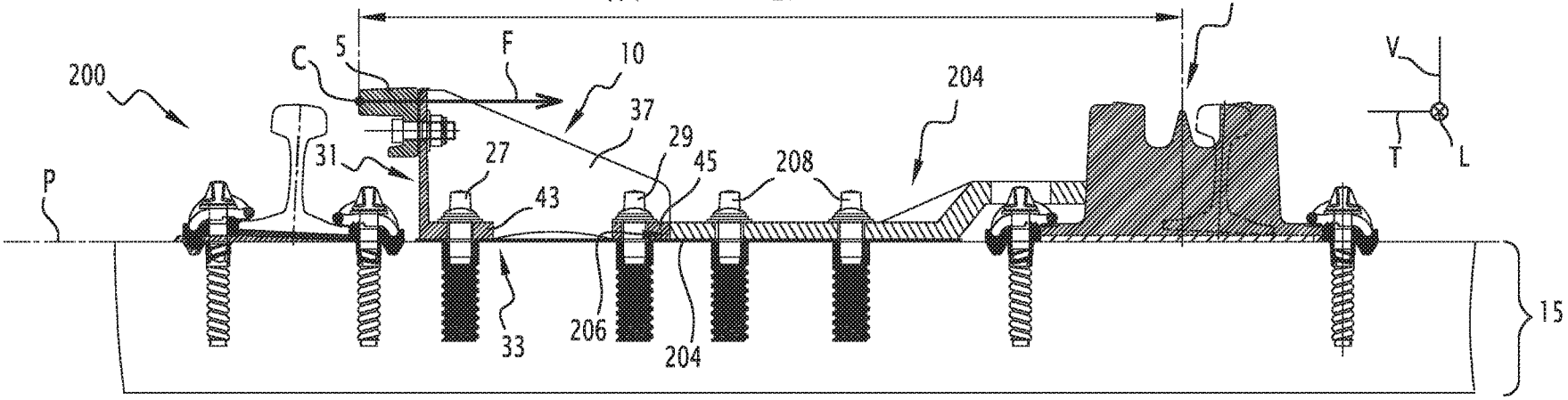
FIG. 10 shows an assembly according to a third embodiment of the invention, wherein the assembly comprises a guide rail support similar to the guide rail support shown in FIG. 1, and a spacer extending between the guide rail support and a switching point.

FIG. 10 describes an assembly 200 forming a third embodiment of the invention. The assembly 200 is similar to the assembly 1 shown in FIG. 1. The similar elements have the same reference numerals and is not described again. Only the differences are described in detail below.

The assembly 200 further comprises a switching point 202 located at the rear of the guide rail support 10, wherein a spacer 204 extends transversely between the switching point and the guide rail support.

The spacer 204 forms an abutment 206 designed to limit a possible transverse displacement of the guide rail support 10 relative to the track support 15 and the switching point 202 when the forces F are applied.

The spacer 204 is fixed to the track support 15, for example by one or more lag bolts 208.

The spacer 204 transversely supports the switching point 202.

The distance between the application point of the forces F on the guide rail 5 and the switching point 202 transversely defines a gap E1 called the protection edge.

By virtue of the spacer 204, the possible transverse displacement of the guide rail support 10 is further limited.

It goes without saying that the specific characteristics of the embodiments and variants described above are possibly combined in all technically feasible combinations to form other variants or embodiments.

In addition, the base plate 19 is optional in assemblies 1, 100 and 200.

What is claimed is:

1. A guide rail support intended to withstand forces exerted in a transverse direction of a railway track on a guide rail extending in a longitudinal direction of the track, the guide rail support comprising:

a front face in the transverse direction intended to support the guide rail or an attachment part of the guide rail, a lower face in a third direction, wherein the third direction is substantially perpendicular to the longitudinal direction and to the transverse direction, and wherein the lower face transversely has at least a front section and a rear section, while the lower face is intended to define a contact plane with a track support, at least one reinforcement rib transversely connecting the front face and the rear section of the lower face, and at least one second reinforcement rib transversely connecting the front face and the rear section of the lower face, wherein the reinforcement rib, the second reinforcement rib, the rear section and the front section define an opening in the lower face in the third direction, wherein the rear section and the front section respectively define, in the contact plane, two distinct contact surfaces separated by a section of the contact plane that is devoid of any contact with the lower face, and wherein the reinforcement rib spans said section.

2. The guide rail support according to claim 1, wherein the lower face comprises an arcuate wall transversely connecting the rear section and the front section, wherein the arcuate wall spans said section of the contact plane, while the arcuate wall preferably forms a lower edge of the reinforcement rib in the third direction.

3. The guide rail support according to claim 1, wherein the front face comprises an upper wall intended to receive the guide rail or an attachment part of the guide rail, and a lower wall located under the upper wall in the third direction, wherein the lower wall connects the upper wall to the front section of the lower face, while the lower wall is devoid of any opening.

4. The guide rail support according to claim 1, wherein the rear section of the lower face defines one of an abutment or a housing intended to interact with the other of an abutment or a housing of the track support intended to oppose a transverse displacement of the guide rail support rearwards with respect to the track support.

5. The guide rail support according to claim 1, wherein the rear section comprises at least one non-integral section with the reinforcement rib, wherein the non-integral section forms an abutment designed to oppose a transverse displacement of the reinforcement rib rearwards with respect to the track support.

6. An assembly comprising:

a guide rail support according to claim 1, a guide rail intended to absorb the forces exerted transversely, wherein the forces are intended to be applied at an application point, wherein the application point is the furthest away from the rear section of the guide rail support in the transverse direction, and wherein the application point is located at a height with respect to the contact plane in the third direction, and at least one first attachment fixing the guide rail on the front face or on an attachment part, at least one second attachment intended to fix the front section on the track support, and at least one third attachment intended to fix the rear section to the track support, wherein the second attachment and the third attachment are transversely separated by a center distance, wherein a ratio of the center distance to the height is between 0.25 and 10.

7. The assembly according to claim 6, further comprising a track support, wherein the front section and the rear section of the lower face are fixed on the track support, and wherein the track support comprises a base plate and an insulating base plate interposed between the two contact surfaces and the base plate in the third direction, wherein the insulating base plate has one or more of the following properties:

the insulating base plate has a thickness of between 1 and 5 mm, the insulating base plate is made of polymer, and the insulating base plate has a hardness of between 50 and 100 Shore A.

8. The assembly according to claim 7, wherein the insulating base plate has a thickness of between 1.5 and 2.5 mm.

9. The assembly according to claim 6, further comprising:

a switching point, and a spacer extending in the transverse direction between the switching point and the guide rail support.

10. The assembly according to claim 6, wherein the ratio of the center distance to the height is between 0.75 and 5.

11. The assembly according to claim 6, wherein the ratio of the center distance to the height is between 1.0 and 3.

12. A guide rail support intended to withstand forces exerted in a transverse direction of a railway track on a guide rail extending in a longitudinal direction of the track, the guide rail support comprising:

a front face in the transverse direction intended to support the guide rail or an attachment part of the guide rail, a lower face in a third direction, wherein the third direction is substantially perpendicular to the longitudinal direction and to the transverse direction, and wherein the lower face transversely has at least a front section and a rear section, while the lower face is intended to define a contact plane with a track support, and at least one reinforcement rib transversely connecting the front face and the rear section of the lower face, wherein the rear section and the front section respectively define, in the contact plane, two distinct contact surfaces separated by a section of the contact plane that is devoid of any contact with the lower face, and wherein the reinforcement rib spans said section, wherein the rear section of the lower face comprises a first section, and a second section protruding transversely from the first section toward the front section, and wherein the second section has at least one additional attachment or abutment intended to interact with the track support, while the second section defines an additional contact surface in the contact plane.

13. An assembly comprising:

a guide rail support according to claim 12, a guide rail intended to absorb the forces exerted transversely, wherein the forces are intended to be applied at an application point, wherein the application point is the furthest away from the rear section of the guide rail support in the transverse direction, and wherein the application point is located at a height with respect to the contact plane in the third direction, and at least one first attachment fixing the guide rail on the front face or on an attachment part, at least one second attachment intended to fix the front section on the track support, and at least one third attachment intended to fix the rear section to the track support, wherein the second attachment and the third attachment are transversely separated by a center distance, wherein a ratio of the center distance to the height is between 0.25 and 10.

14. The assembly according to claim 13, further comprising a track support, wherein the front section and the rear section of the lower face are fixed on the track support, and wherein the track support comprises a base plate and an insulating base plate interposed between the two contact surfaces and the base plate in the third direction, wherein the insulating base plate has one or more of the following properties:

the insulating base plate has a thickness of between 1 and 5 mm, the insulating base plate is made of polymer, and the insulating base plate has a hardness of between 50 and 100 Shore A.

15. The assembly according to claim 14, wherein the insulating base plate has a thickness of between 1.5 and 2.5 mm.

16. The assembly according to claim 13, further comprising:

a switching point, and a spacer extending in the transverse direction between the switching point and the guide rail support.

17. The assembly according to claim 13, wherein the ratio of the center distance to the height is between 0.75 and 5.

18. The assembly according to claim 13, wherein the ratio of the center distance to the height is between 1.0 and 3.

* * * * *